US005460362A

United States Patent [19]

Fassman et al.

[11] Patent Number: 5,460,362

[45] Date of Patent: Oct. 24, 1995

[54] MAILING MACHINE INCLUDING MODIFIABLE MAILPIECE DRIVE

[75] Inventors: Arnold Fassman, Westport; Joseph F. Miciukiewicz, Trumbull, both of Conn.

[73] Assignee: Pitney Bowes Inc., Stamford, Conn.

[21] Appl. No.: 273,298

[22] Filed: Jul. 11, 1994

[51] Int. Cl.[6] ..... B65H 5/00

[52] U.S. Cl. ..... 271/264; 271/273; 271/314

[58] Field of Search ..... 271/264, 273, 271/274, 314; 198/861.1, 790

[56] References Cited

U.S. PATENT DOCUMENTS

| | | | |
|---|---|---|---|
| 2,230,670 | 2/1941 | Sieger | 271/273 |
| 2,871,781 | 2/1959 | Schrempp | 271/314 |
| 3,476,383 | 11/1969 | Wilcox et al. | 271/314 |
| 4,170,348 | 10/1979 | Hoeink et al. | 271/274 |
| 4,353,543 | 10/1982 | Ikeda et al. | 271/273 |
| 4,763,575 | 8/1988 | Miciukiewicz | 271/274 |
| 4,901,845 | 2/1990 | Zorgiebel | 198/790 |
| 5,390,594 | 2/1995 | Nobile et al. | 101/92 |
| 5,392,703 | 2/1995 | Makarchuk et al. | 101/92 |
| 5,392,704 | 2/1995 | Silverberg et al. | 101/92 |

*Primary Examiner*—H. Grant Skaggs

*Attorney, Agent, or Firm*—Steven J. Shapiro; Dvid E. Pitchenik; Melvin J. Scolnick

[57] ABSTRACT

An improved mailing machine has a modifiable deck for accommodating a mailpiece feeder. The mailing machine is modified by providing a plate which may be incorporated into the deck. The plate carries a positive drive mechanism for the feeding of mailpieces at the desired speed which comprises a positive drive roller and pulley which are aligned to use the drive mechanism of the mailing machine for belt driven power.

5 Claims, 4 Drawing Sheets

MAILING MACHINE INCLUDING MODIFIABLE MAILPIECE DRIVE

FIELD OF THE INVENTION

The invention relates to mailing machines and more particularly to an improvement in a mailing machine for combination with an automatic mailpiece feeding device.

BACKGROUND OF THE INVENTION

Mailing machines generally comprise a postage meter for printing an indicia on a piece of mail or on a tape and a feed base for transporting mailpieces or tapes for printing by the postage meter. In many cases for reasons of cost and typically because of lighter volume of mail, automatic mailpiece feeders have not been used in connection with small mailing machines.

One type of mailing machine produced by Pitney Bowes, which is described, for example, in Ser. No. 180,163 now U.S. Pat. No. 5,392,704, for Mailing Machine, Ser. No. 180,161, now U.S. Pat. No. 5,392,703, and Ser. No. 180,168 now U.S. Pat. No. 5,390,594, for Tape Feeding, Cutting and Ejecting Apparatus for a Mailing Machine all filed Jan. 11, 1994, and assigned to the assignee of the instant application, was originally designed for the hand feeding of mail by an operator.

If it is desired that an automatic mail-feeding apparatus be used in combination with this mailing machine, it was found necessary to be able to convert such mailing machines for automatic mail feeding. The length of the deck and the lack of positive feeding make the interface of these mailing machines to the feeder less than straightforward.

SUMMARY OF THE INVENTION

It is therefore an object of the invention to provide an improved mailing machine having a modifiable deck for accommodating a mailpiece feeder.

It has been found that the mailing machine can be modified by providing a plate which may be incorporated into the deck, the plate carrying a positive drive mechanism for the feeding of mailpieces at the desired speed. For best results, it was found that the drive mechanism comprises a positive drive roller and pulley which are aligned to use the drive mechanism of the mailing machine for belt driven power.

Thus the above and other objects are attained in a novel mailing machine of the type having a deck and a feeding roller for transporting mailpieces along the deck, the improvement comprising the deck having a hole therein and a plate for filling said hole, said plate having a driven wheel mounted thereon, the wheel extending upwardly through the plate for engaging and transporting a mailpiece prior to the engagement by the feeding roller, and belt drive means connecting the feeding roller and the driven wheel for providing driving power to the driven wheel for transport of the mailpieces.

In a further aspect there is provided a method for interfacing a mailing machine to an automatic feeder, the mailing machine having a deck and drive means for a feeding roller mounted thereon for transport of mailpieces, the method comprising the steps of providing a hole in the deck of the mailing machine, providing a plate having dimensions for fitting in the hole, mounting on said plate a driven wheel, a portion of said driven wheel extending upwardly through a slot in the plate for engaging with a mailpiece and being aligned so as to receive driving power from the drive for the feeding roller, placing and retaining the plate in the hole in the deck, and connecting the driven wheel to the feeding roller drive means by belt drive means for transporting the mailpieces.

DESCRIPTION OF THE PREFERRED EMBODIMENT

Figure 1:
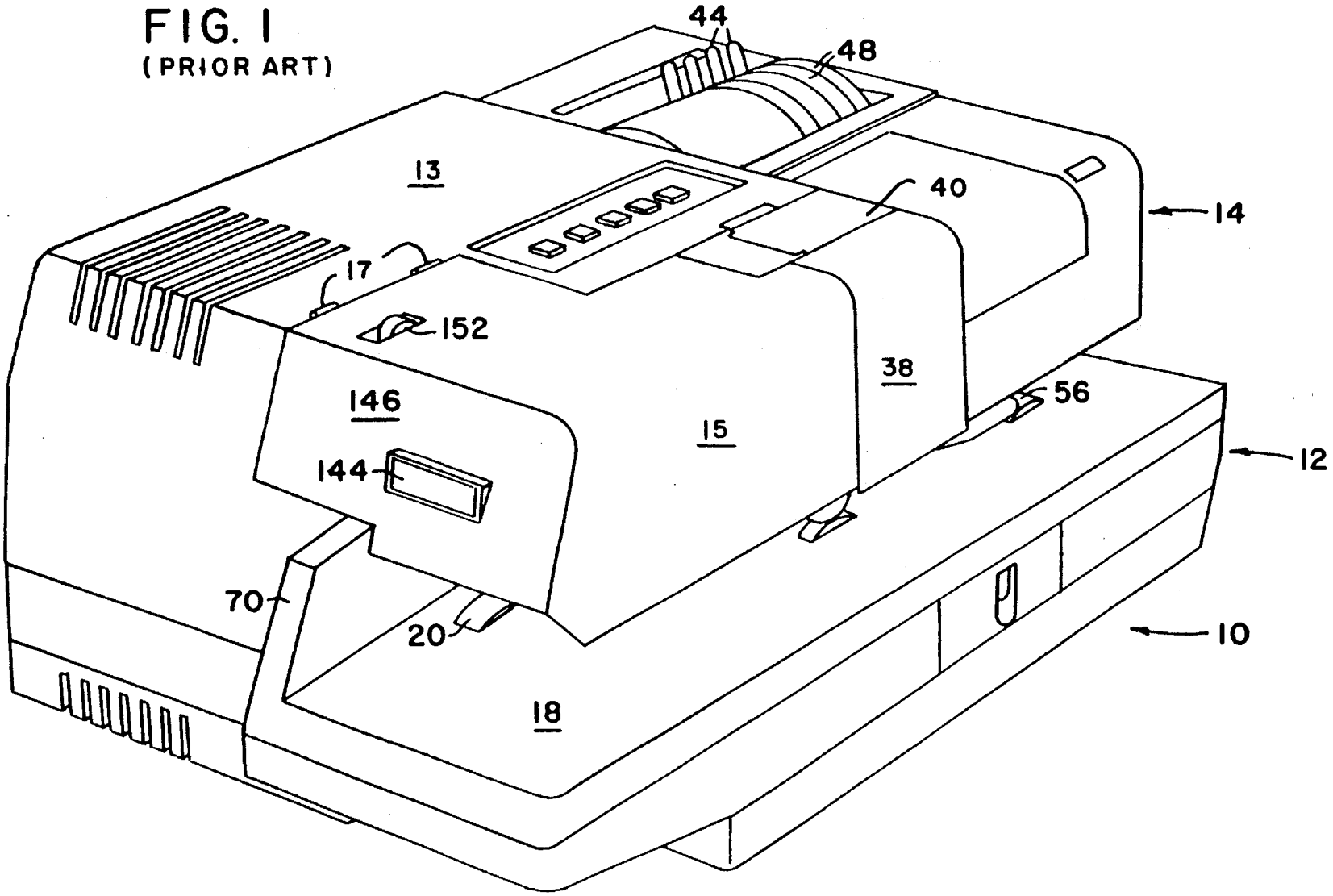
FIG. 1 (PRIOR ART)
FIG. 1 is a general perspective view of a mailing machine embodying the present invention.
Figure 2:
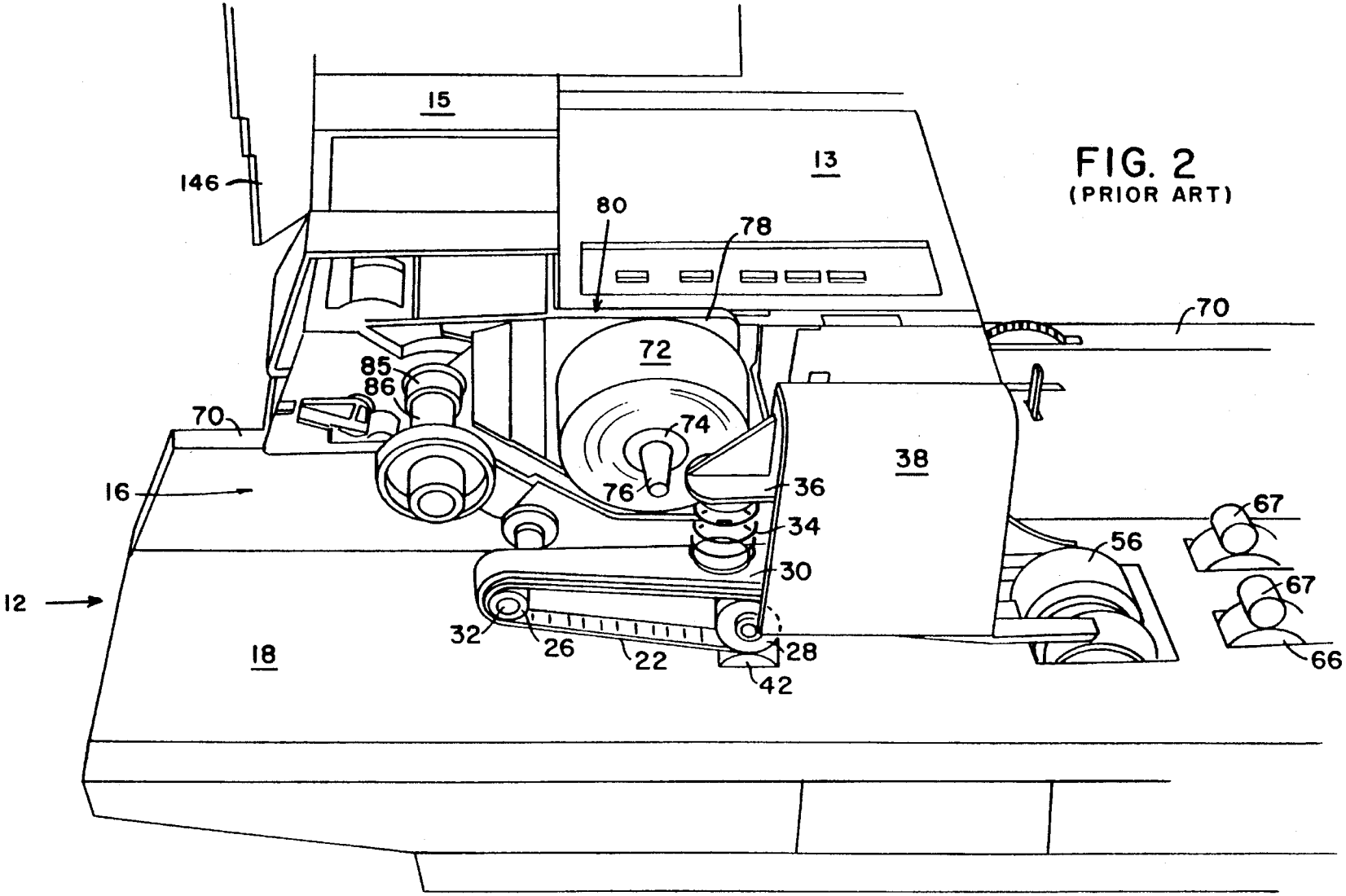
FIG. 2 (PRIOR ART)
FIG. 2 is a frontal perspective view of the mailing machine shown in FIG. 1 with some covers removed for ease of viewing.

In FIGS. 1 and 2, there is shown generally at 10 a mailing machine as described generally in applications Ser. No. 180,163 for Mailing Machine, Ser. No. 180,161 and Ser. No. 180,168 for Tape Feeding, Cutting and Ejecting Apparatus for a Mailing Machine all filed Jan. 11, 1994, each assigned to the assignee of the present invention and specifically incorporated herein by reference.

The mailing machine includes a base shown generally at 12, a postage meter generally designated at 14, and a tape feeding, cutting, and ejection apparatus shown generally at 16 (FIG. 2). The mailing machine preferably includes a housing having a pivoted cover 15 connected by hinges 17 which can be raised to provide access.

The base 12 comprises a feed deck 18 which extends through the mailing machine 10 for support of mailpieces. Feeding rollers 20 project upward through the deck for engaging the underside of the mailpieces while belt 22 which extends around drive pulley 26 and idler pulley 28 serves to engage the upper surface for transporting the mailpiece for feeding to the postage meter. The outer surface of belt 22 passing around idler pulley 28 is mounted on elongate housing 30 which is pivoted about shaft 32 which drives the pulley 26. Housing 30 is spring loaded downwardly by spring 34 on bracket 36 formed on ink cartridge housing 38 which holds a removable ink cartridge 40. Belt 22 engages an roller 42 mounted beneath the feed deck 18 which acts as a pressure backup to ensure proper feeding of mailpieces between the belt 22 and roller 42.

Postage meter 14 has a plurality of setting levers 44 for setting postage in accordance with numerals on scales 48. The postage meter includes a print drum which carries a printing die for printing the indicia on a mailpiece.

As seen in FIG. 2, the base further includes a plurality of eject rollers 66 and cooperating spring loaded pressure rollers 67 in the postage meter for conveying the mailpiece to the end of the feed deck.

The drive mechanism is implemented suitably with a DC reversing motor (not seen in these figures) as described in connection with applications Ser. No. 180,161 and Ser. No. 180,168 for Tape Feeding, Cutting and Ejecting Apparatus for a Mailing Machine, previously incorporated by reference herein. The complete operation is described in these referenced applications and will not be further described herein except as required for the discussion of the present invention.

It has been found that in some applications, an automatic mailpiece feeder is required so as to be able to automatically feed mailpieces to the mailing machine, but the machine illustrated in the prior art does not provide a way to easily accommodate the mail feeder.

Figure 3:
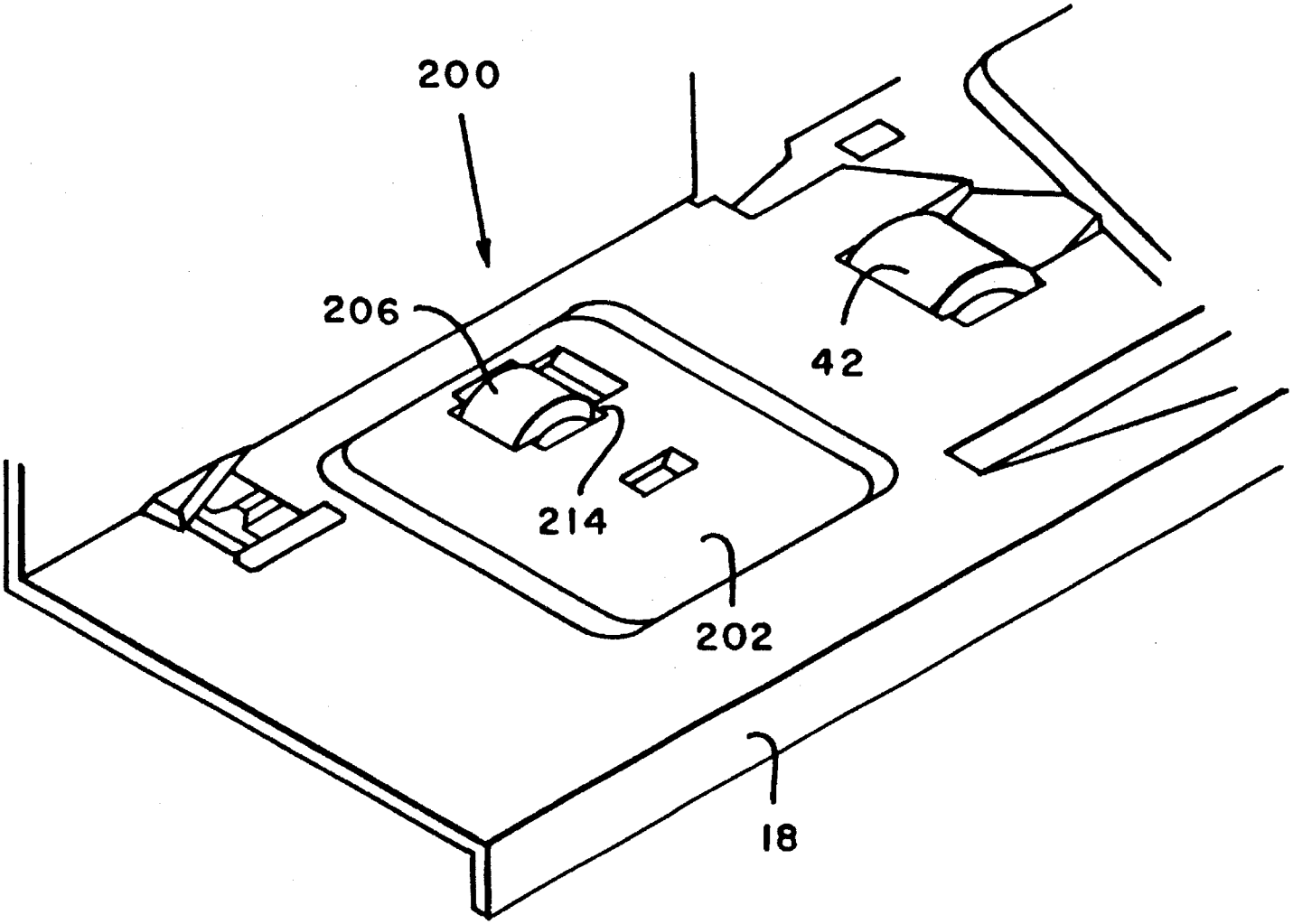
FIG. 3 is a frontal perspective view of the base of the mailing machine shown in FIG. 1 having a plate in accordance with the invention.
Figure 4:
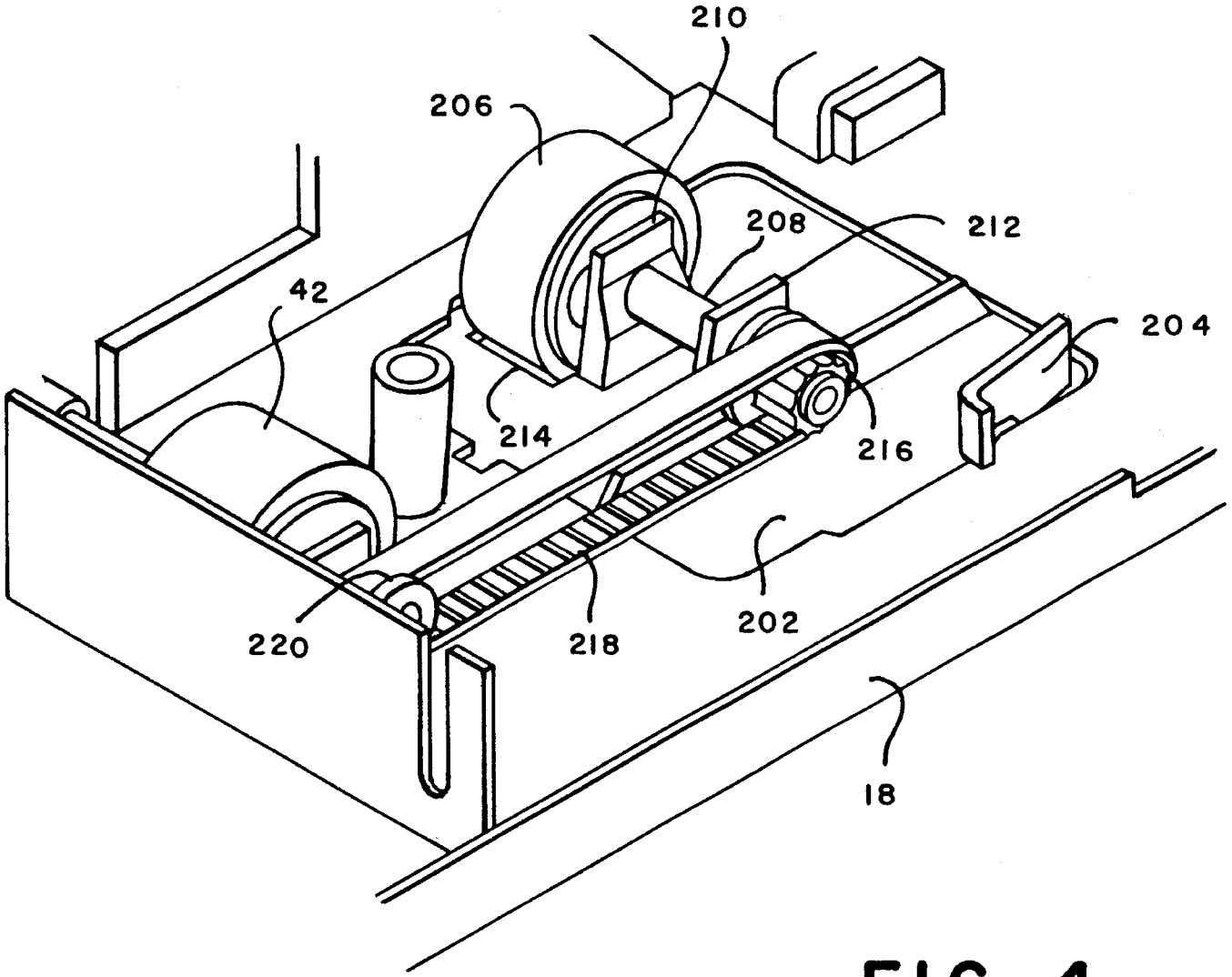
FIG. 4 is a bottom perspective view of the plate in accordance with the invention shown installed in the base.

In FIG. 3, a modified deck in accordance with the invention is shown generally at 200. In order to modify the mailing machine to accommodate an automatic feeder, the end 70 of the prior art mailing machine (FIG. 1) is trimmed and an L-shaped cap (not shown) is placed to cover the trimmed end. Further in accordance with the invention, a substantially square or rectangular hole is provided in the deck and a molded plate 202 of substantially the same dimensions is received into the hole. As best seen in FIG. 4, a tab 204 or the like is suitably molded as a part of the plate and when the plate is inserted into the hole, the tab 204 will deform and then spring back to hold the plate 202 in place.

As shown in FIGS. 3 and 4, an additional roller or wheel 206 is mounted on shaft 208 which is in turn journalled on the plate 202, suitably as shown at molded projections 210 and 212, so that a portion of the circumference of wheel 206 extends through the plate at slot 214. On the other end of shaft 208 is mounted a pulley 216 connected by belt 218 to pulley 220 suitably mounted on the shaft of roller 42 of FIG. 2, which is driven by a motor not seen in the Figs. The wheel 206 thus is driven by the power provided to the existing feeding roller 42 of the mailing machine.

For best results, a spring-loaded straddler (not shown) has arms projecting from above the deck on each side of the wheel 206 in order to provide a positive contact on the wheel 206 by pushing on the top of the mailpiece as it passes over the wheel 206.

In operation, with the mailing machine juxtaposed to an automatic feeder, a mailpiece which is received on the deck is positively engaged by the wheel 206 and transported to the nip of the feeder wheel using the power from the same drive means as drives the feeder wheel 42. When the deck is trimmed as shown in FIG. 3, the length of path is reduced to allow mailpieces of the required minimum length to be fed.

What is claimed is:

1. In a mailing machine of the type having a deck and a feeding roller for transporting mailpieces along the deck, the improvement comprising the deck having a hole therein and a plate for filling said hole, said plate having a driven wheel mounted thereon, the wheel extending upwardly through the plate for engaging and transporting a mailpiece prior to the engagement by the feeding roller, and drive means connecting the feeding roller and the driven wheel for providing driving power to the driven wheel for transport of the mailpieces.

2. The mailing machine of claim 1 wherein the drive means is a belt drive means.

3. The machine of claim 1 wherein the plate further comprises tab means on said plate for holding the plate in the hole of the deck.

4. A method for interfacing a mailing machine to an automatic feeder, the mailing machine having a deck and drive means for a feeding roller mounted thereon for transport of mailpieces, the method comprising the steps of providing a hole in the deck of the mailing machine, providing a plate having dimensions for fitting in the hole, mounting on said plate a driven wheel, a portion of said driven wheel extending upwardly through a slot in the plate for engaging with a mailpiece and being aligned so as to receive driving power from the drive for the feeding roller, placing and retaining the plate in the hole in the deck, and connecting the driven wheel to the feeding roller drive means by a drive means for transporting the mailpieces.

5. The method of claim 4 wherein the drive means is a belt drive means.

* * * * *